US005083482A

United States Patent [19]

Floyd

[11] Patent Number: 5,083,482

[45] Date of Patent: Jan. 28, 1992

[54] LID WRENCH

[76] Inventor: Fred D. Floyd, 1403 Fairview Ave., Monroe, La. 71201

[21] Appl. No.: 600,662

[22] Filed: Oct. 22, 1990

Related U.S. Application Data

[63] Continuation-in-part of Ser. No. 506,158, Apr. 9, 1990, Pat. No. 4,995,295.

[51] Int. Cl.[5] ..... B67B 7/00

[52] U.S. Cl. ..... 81/3.44; 81/3.42; 269/166

[58] Field of Search ..... 81/3.42, 3.44, 150, 81/151; 269/166

[56] References Cited

U.S. PATENT DOCUMENTS

| | | | |
|---|---|---|---|
| 783,550 | 2/1905 | Smith | 81/150 |
| 2,578,379 | 12/1951 | Taylor | 81/3.44 |
| 2,913,938 | 11/1959 | Yorba | 81/3.44 |
| 2,923,334 | 12/1960 | Brennan | 269/166 X |
| 2,931,258 | 4/1960 | Ronning | 81/3.44 |
| 3,218,058 | 11/1965 | Smith | 269/166 X |
| 4,088,313 | 5/1978 | Pearson | 269/166 X |
| 4,949,576 | 8/1990 | Floyd | 81/3.44 |

FOREIGN PATENT DOCUMENTS

| | | | |
|---|---|---|---|
| 587004 | 4/1947 | United Kingdom | 81/3.44 |
| 648030 | 12/1950 | United Kingdom | 81/3.44 |

*Primary Examiner*—James G. Smith
*Attorney, Agent, or Firm*—John M. Harrison

[57] ABSTRACT

A lid wrench for removing lids from jars and other containers, which lid wrench is characterized in a first preferred embodiment by a smooth, elongated lug-receiving member slidably receiving a single sliding lug provided with inwardly-facing lug teeth. In a second preferred embodiment, the lug-receiving member is provided with spaced slots or teeth for selectively receiving an engaging shoulder or shoulders of the sliding lug. A fixed handle is attached to an offset end of the lug-receiving member opposite the sliding lug and an opening and/or ring maybe provided in the opposite end of the lug-receiving member for suspending the lid wrench from a nail or other support. A spring-biased, curved jaw, provided with multiple, spaced jaw teeth which face the lug teeth on the sliding lug, is pivotally secured to the offset end of the lug-receiving member spaced from the fixed handle, and receives a jaw handle. Gripping and squeezing of the fixed handle and the jaw handle pivots the curved jaw against the bias of the spring in a camming action against a jar lid or cap disposed between the jaw teeth and the lug teeth located on the sliding lug, to lock the lug on the lug-receiving member and loosen the lid or cap responsive to twisting of the lid wrench.

28 Claims, 1 Drawing Sheet

LID WRENCH

BACKGROUND OF THE INVENTION

1. Cross-Reference to Related Applications

This application is a continuation-in-part of my copending U.S. patent application Ser. No. 07/506,158, filed Apr. 9, 1990 now U.S. Pat. No. 4,995,295.

2. Field of the Invention

This invention relates to tools for removing lids and caps from jars and other containers. More particularly, the invention relates to a lid wrench for accomplishing this function, which lid wrench is characterized by an elongated lug-receiving member or bar fitted with a slidably adjustable lug having a bevelled bar opening and lug teeth on one face thereof. A fixed handle is mounted in fixed relationship on an offset end of the lug bar and a curved jaw, fitted with multiple teeth which face the lug teeth located on the sliding lug and spring-loaded in the open configuration, is pivotally attached to the offset end of the lug bar and is fitted with a jaw handle. Accordingly, squeezing the jaw handle toward the fixed handle against the bias of a coil spring seated between the offset end of the lug bar and the curved jaw, causes the jaw to pivot in a camming action toward the lug to grip a jar lid or container cap positioned between the jaw teeth and the lug teeth. The pivoting lug is slidably and adjustably mounted on the lug bar such that jar lids and other container lids and caps of various diameter can be fitted between the lug teeth and the jaw teeth in easily adjustable fashion and the camming action of the jaw against the lid secures the lid between the jaw teeth and the lug teeth to facilitate loosening the jar lid with a twisting action of the hand. The coil spring is mounted on a jaw pin which connects the curved jaw to the offset end of the lug bar, with one end of the spring engaging the lug-receiving lug bar and the opposite end engaging the curved jaw, and serves to normally bias the jaw handle away from the fixed handle in open configuration.

A frustrating problem which is well known to everyone is that of loosening threaded jar lids and other container caps and lids to remove the contents of the container. The problem is not limited to lids and caps which are compression-sealed and threaded on jars and other containers, but also to plastic caps or covers which are sometimes sealed by means of plastic retainers on beverage bottles and other containers. In the case of many beverage bottles, the plastic retainers must first be severed by a knife before the lid can be removed, a practice which is dangerous and time-consuming. Since the lids applied to such containers as pickle jars, for example, are normally smooth and difficult to grip, the lids are frequently difficult to remove with the bare hands, even by one having a strong grip.

Various types of jar-opening aids and mechanisms have been devised and are known in the art for removing lids and caps from jars and other containers. A commonly used device is a flexible rubber disk which is placed over the jar lid and gripped by the user to maintain a tight friction fit between the hand and the jar lid, in order to exert sufficient friction to open the lid. Another device is detailed in U.S. Pat. No. 936,035, dated Oct. 5, 1909, to W. A. Pratt, entitled "Wrench". The Pratt wrench is characterized by a pair of generally Z-shaped rods or bars which are pivoted at one end and contain a V-shaped member for engaging a jar or container lid, gripping the lid and exerting sufficient pressure to remove the lid from the container. U.S. Pat. No. 1,398,125, dated Nov. 22, 1921, to W. A. Carleton, et al, details another wrench which includes an elongated handle provided with a pair of jaws thereon, the jaws having jaw teeth for receiving, engaging and removing a jar lid. A "Can Top Remover" is detailed in U S. Pat. No. 2,002,906, dated May 28, 1935, to J. H. Mullan. The can top remover is characterized by an elongated, slotted plate provided with a set of fixed teeth at the end thereof and a handle pivotally and slidably attached to the fixed member at the slot. The handle is fitted with additional jaw teeth for slidably engaging a container lid located between the two sets of teeth, rotating the handle and removing the lid. U.S. Pat. No. 1,672,311, dated June 5, 1928, to P. Ermatinger, details a "Jar Holder" which is characterized by a split-ring provided with a pair of handles and fitted with oppositely-disposed, slotted adjusting members, wherein the fixed ring can be fitted over a jar cap or lid, the adjusting members adjusted on the ring to engage the cap or lid and the handles of the ring squeezed to tighten the ring, secure the adjusting members against the cap or lid and remove the lid. A "Receptacle Cover Pry-Off Tool" is detailed in U.S. Pat. No. 2,458,806, dated Jan. 11, 1949, to J. C. Tippett. The pry-off tool is characterized by a handle provided with a threaded rod and having a pair of oppositely-disposed, concave jaws fitted with jaw teeth, one of which jaws is fixed to the end of the threaded rod and the other threadably adjustable thereon. The lid of a jar or other container is fitted between the two sets of jaws and the threaded jaw is then tightened against the lid to facilitate removal of the lid from the jar or container. U.S. Pat. No. 2,507,789, dated May 16, 1950, to S. E. Jessup, details a "Reciprocating Jaw Jar Wrench" which includes an elongated plate provided with a pair of oppositely-disposed jaws having jaw teeth, both of which jaws are movable on the plate. One of the jaws is fitted with a spring-loaded handle for exerting pressure against a container lid located between the jaws and removing the container lid from the container. U.S. Pat. No. 2,541,216, dated Feb. 13, 1951, to G. T. Derby, details a "Pivoted Jaw Screw Cap Remover". The device includes a flat, elongated, slotted plate provided with a first jaw fixed to the end thereof and a slidably adjustable jaw located intermediate the ends of the plate. The adjustable jaw is adjusted by means of a rod attached thereto to secure the jaws against a lid or cap located therebetween and remove the lid or cap from a container. U.S. Pat. No. 2,578,379, dated Dec. 11, 1951, to S. M. Taylor, details a "Pivoted Jaw Closure Remover with Eccentric Pivot". The device includes a mount plate provided with an adjustable jaw at one end, which jaw is adjustable on the mount plate by means of a peg-and-hole arrangement. An eccentric cam is provided at the opposite end of the mount plate for engaging one side of a jar lid, the opposite side of the lid engaging the adjustable plate for removing the lid from the jar. U.S. Pat. No. 2,931,258, dated Apr. 5, 1960, to J. A. Ronning, Jr., details an "Opener for Screw Caps". The opener is characterized by an elongated base member provided with spaced slots and a downwardly-extending grip portion at one end, with a handle adjustably attached to the elongated member by means of a pin and having a lug which engages a jar or container lid located between the grip portion and the handle lug for removing the lid from the container. My U.S. Pat. No. 4,949,576, dated Aug. 21, 1990, details a self-adjusting lid wrench having an elongated channel and parallel, spaced, gravity-operated pivoting lugs attached to the channel for cooperating with a pivotal jaw and engaging a jar lid or cap for removal purposes.

It is an object of this invention to provide a new, improved and simplified lid wrench which is characterized by an elongated lug-receiving member having a single pivoting lug slidably fitted thereon and adapted to traverse the lug-receiving member, a fixed handle mounted on one end of the lug-receiving member and a pivoting jaw and companion jaw handle pivotally attached to the same end of the lug-receiving member adjacent to the fixed handle, for securing the lid of a container between the pivoting jaw and the lug in adjustable relationship and loosening the lid on the container.

Another object of the invention is to provide a lid wrench which is characterized by an elongated lug-receiving member or bar fitted with one or more sets of spaced slots or teeth and a sliding lug having a tapered slot for receiving the lug-receiving member, with lug teeth provided on one face of the lug and one or more engaging shoulders located in the tapered slot for sliding on the lug-receiving member and selectively and adjustably engaging the bar slots or teeth. A fixed handle is attached to one end of the lug bar and a pivoting jaw, fitted with jaw teeth and a jaw handle, is pivotally secured to the same end of the lug bar adjacent to the fixed handle, wherein squeezing of the two handles rotates the pivoting jaw toward the lug and secures a container lid between the lug and the pivoting jaw, to facilitate twisting the container lid from the container.

Yet another object of this invention is to provide a new and improved lid wrench which is characterized by a lug-receiving plate or bar having a selected cross-sectional configuration; a single lug having a tapered slot for receiving the plate or bar in slidably adjustable relationship and having multiple teeth for engaging one side of a container lid; a fixed handle attached to an offset end of the plate or bar; and a pivoting jaw and companion jaw handle pivotally attached to the offset end of the plate or bar in spaced, spring-biased relationship with respect to the fixed handle, for engaging the opposite side of the container lid and loosening the container lid on the container with a counterclockwise twist of the hand.

Still another object of this invention is to provide a new and improved lid wrench which is characterized by a lug-receiving plate or bar having a selected cross-sectional configuration and at least one set of bar slots or teeth on the top and/or bottom surface thereof; a single lug having a tapered slot for receiving the plate or bar in slidably adjustable relationship, with one or more lug shoulders provided in the tapered slot for selectively engaging the bar teeth and multiple teeth provided on the lug for engaging the edge of a container lid; a fixed handle attached to one end of the plate or bar; and a pivoting jaw and companion jaw handle pivotally attached to the same end of the plate or bar in spaced, spring-biased relationship with respect to the fixed handle, for engaging the opposite edge of the container lid and loosening the container lid on the container with a twist of the hand.

SUMMARY OF THE INVENTION

These and other objects of the invention are provided in a new and improved lid wrench for removing lids and caps from jars and other containers, which lid wrench is characterized by an elongated, round, polygonal or flat lug plate or bar optionally fitted with multiple, spaced slots or teeth on the top and/or bottom surface thereof; a lug having a tapered slot or opening for slidably receiving the lug bar, the lug slot having top and bottom engaging shoulders capable of selectively engaging the lug bar and the optional teeth on the lug member; a fixed handle rigidly provided on an offset end of the lug member opposite the lug; a curved, toothed jaw pivotally attached to the offset end of the lug member and a jaw handle rigidly attached to the jaw and spaced from the fixed handle; and a coil spring seated in a cavity between the jaw and the offset end of the lug bar for biasing the jaw handle and fixed handle apart. A container lid may be disposed between the jaw teeth and the lug teeth and gripped by squeezing the handles and urging the jaw handle toward the fixed handle against the spring bias to grip the lid and remove the lid from the container with a counterclockwise twist of the hand.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4, 5, 6, 7, 8, 9, 10:
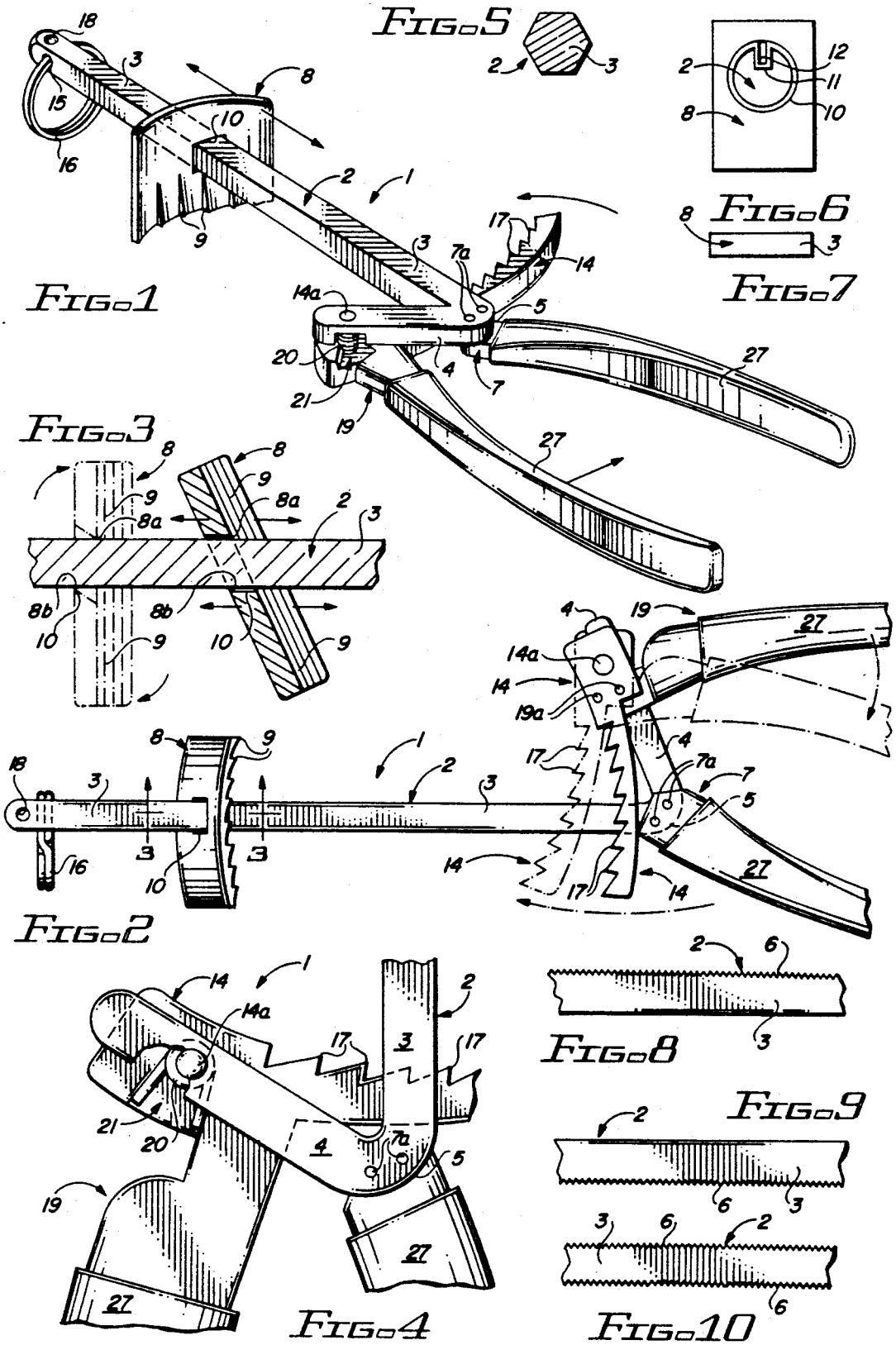
FIG. 1 is a top perspective view of a first preferred embodiment of the lid wrench of this invention.
FIG. 2 is a top view of the lid wrench illustrated in FIG. 1.
FIG. 3 is a sectional view taken along line 3—3 of the lid wrench illustrated in FIG. 2.
FIG. 4 is an enlarged bottom sectional view of the jaw and handle segment of the lid wrench illustrated in FIGS. 1 and 2.
FIG. 5 is a cross-sectional view of an alternative hexagonally-shaped lug bar element of the lid wrench illustrated in FIGS. 1 and 2.
FIG. 6 is a front view of a round lug bar configuration and a lug modified to slidably engage the round lug bar in an alternative embodiment of the lid wrench of this invention.
FIG. 7 is an end view of yet another alternative rectangular-shaped lug bar for use in the lid wrench illustrated in FIGS. 1 and 2.
FIG. 8 is a side view, partially in section, of the lid wrench lug bar illustrated in FIGS. 1 and 2, with teeth provided in the top surface thereof.
FIG. 9 is a side view, partially in section, of the lid wrench lug bar illustrated in FIGS. 1 and 2, with teeth provided in the bottom surface thereof.
FIG. 10 is a side view, partially in section, of the lid wrench lug bar illustrated in FIGS. 1 and 2, with teeth provided in the bottom and top surfaces thereof.

Referring initially to FIGS. 1, 2 and 4 of the drawing, in a first preferred embodiment of the invention the lid wrench is generally illustrated by reference numeral 1. The lid wrench 1 is characterized by an elongated lug bar 2, constructed of smooth, square metal bar stock having a straight lug-receiving segment 3 and a handle mount segment 4, which is offset from the lug-receiving segment 3 at a bend 5. An optional bar opening 18 is provided in one end of the lug-receiving segment 3 for suspending the lid wrench 1 from a nail, peg or other protrusion (not illustrated), when the lid wrench 1 is not in use. A ring opening 15 may also be provided in the same end of the lug bar for receiving a split ring 16 and achieving the same purpose. A fixed handle 7 is secured to the opposite, handle mount segment 4 end of the lug bar 2 at the bend 5, by means of fixed handle brads 7*a*, as further illustrated in FIGS. 1, 2 and 4. One end of a curved jaw 14 is pivotally secured to the handle mount segment 4 by means of a jaw pin 14*a*, also illustrated in FIGS. 1, 2 and 4, which jaw pin 14*a* extends through a jaw pin opening (not illustrated), provided in the base of the jaw 14 and through a corresponding, aligned opening (not illustrated), in the handle mount segment 4. A jaw handle 19 is fixedly attached to the pivoted end or base of the jaw 14 by aeans of jaw handle brads 19*a*. The curved jaw 14 is fitted with multiple jaw teeth 17, which extend along the concave edge thereof from just beyond the jaw pin 14*a* to the pivoting end of the jaw 14. As illustrated in FIGS. 1 and 4, a coil spring 20 is seated in a spring seat 21, shaped in the handle mount segment 4 of the lug bar 2, with one end or tang of the coil spring 20 seated in a groove located in the jaw 14 and the other end or tang positioned in the spring seat 21 provided in the handle mount segment 4.

As illustrated in FIGS. 2 and 3 of the drawing, in a most preferred embodiment of the invention the lug 8 is slightly curved from end to end and is fitted with a bar opening 10 which is bevelled at the bottom and top, the bevels extending in parallel relationship from the inside concave surface of the lug 8 upwardly to the outside surface thereof, respectively. This bevelled bar opening 10 defines a top lug shoulder 8*a* at the concave inner surface of the lug 8 and a bottom lug shoulder 8*b*, at the curved outer surface of the lug 8. Accordingly, referring again to FIGS. 2 and 3 of the drawing, a jar lid (not illustrated) may be inserted between the lug teeth 9 of the lug 8 and the corresponding jaw teeth 17 of the curved jaw 14. Squeezing of the jaw handle 19 and the fixed handle 7 pivots the jaw 14 in the direction of the arrow as illustrated in phantom in FIG. 2 and pushes the jar lid against the lug 8. This action pivots the top lug shoulder 8*a* downwardly against the top surface of the lug receiving segment 3 and the bottom lug shoulder 8*b* upwardly against the bottom surface of the lug-receiving segment 3, to bind or lock the lug 8 on the lug-receiving segment 3 of the lug bar 2 and secure the lid. Removal of the lid from the jar is then effected by twisting the lid wrench 1 in the counterclockwise direction.

Referring now to FIG. 6 of the drawing, in an alternative preferred embodiment of the invention the lug bar 2 is round in cross-section and is fitted with a longitudinally-extending bar slot 11, which terminates short of the split ring 16 and is shaped to receive a corresponding lug pin 12, projecting from the lug 8 into the round bar opening 10. Accordingly, the lug is adapted to slide longitudinally on the round lug bar 2 along the bar slot 11, but cannot rotate on lug bar 2, regardless of the relative position of the lid wrench 1. The lug 8 therefore operates in the same manner as the lug 8 mounted on the lug-receiving segment 3 illustrated in FIGS. 1–4, wherein the lug bar 2 is constructed of square bar stock.

In another most preferred embodiment of the invention and referring to FIGS. 5 and 7 of the drawings, the lug bar 2 may be constructed of plate or bar stock having a hexagonal cross-sectional configuration, as illustrated in FIG. 5, or a rectangular cross-sectional configuration, as illustrated in FIG. 7. Alternatively, the lug bar 2 may be constructed in any desired polygonal cross-section and stainless steel is a preferred material of construction.

Referring now to FIGS. 8–10 of the drawings, in yet another preferred embodiment of the invention the lug-receiving segment 3 of the lug bar 2 may be provided with bar teeth 6 located on the top thereof, as illustrated in FIG. 8. Alternatively, the bar teeth 6 may be located only on the bottom of the lug receiving segment 3, as illustrated in FIG. 9 or both on the bottom and top thereof, as illustrated in FIG. 10. While the bar teeth 6 are illustrated in a uniform configuration in FIGS. 8–10 of the drawings, it will be appreciated that the bar teeth 6 may be constructed in the top and/or bottom surfaces of the lug receiving segment 3 in angled configuration, like the jaw teeth 17, such that the top lug shoulder 8*a* and bottom lug shoulder 8*b* of the lug 8 will more securely engage the vertical segments of the bar teeth 6 when pressure is applied on the bottom portion of the lug 8 at the lug teeth 9 by means of a jar lid, as illustrated in FIG. 3. Accordingly, it will be appreciated that however configured, the bar teeth 6 serve to further insure that the lug 8 will not slip or slide along the lug-receiving segment 3 of the lug bar 2 when pressure is applied to the lid 25 by pivotal operation of the jaw 14.

Referring again to FIG. 2 of the drawing, in a most preferred embodiment of the invention, the jaw teeth 17 and lug teeth 9 are tapered or pitched in opposite directions, in order to better grip opposite sides of a jar lid when the lid wrench 1 is twisted to remove the lid.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A lid wrench for removing a lid from a container, comprising elongated lug-receiving means; lug means having an opening for receiving said lug-receiving means, said lug means adapted to slidably traverse said lug-receiving means and selectively engage said lug-receiving means in locked relationship; a fixed handle carried by said lug-receiving means in fixed relationship; jaw means pivotally carried by said lug-receiving means in spaced relationship with respect to said fixed handle; and a jaw handle fixedly carried by said jaw means, whereby said lug means and said jaw means engage the lid and the lid is loosened on the container responsive to insertion of said lid wrench over the lid between said lug means and said jaw means, squeezing said jaw handle toward said fixed handle and twisting said lid wrench.

2. The lid wrench of claim 1 further comprising lug teeth provided on said lug means and wherein said lug opening is tapered at the top and bottom, whereby said lug means is selectively locked on said lug-receiving means in non-slidable configuration with said lug teeth facing said jaw means.

3. The lid wrench of claim 1 wherein said jaw means further comprises a jaw having one end pivotally secured to said lug-receiving means and further comprising a set of jaw teeth provided on said jaw, with said jaw teeth facing said lug means.

4. The lid wrench of claim 1 wherein:

(a) said lug opening is tapered at the top and bottom and further comprising lug teeth provided on said lug, whereby said lug is selectively locked on said lug-receiving means in non-slidable configuration with said lug teeth facing said jaw means; and (b) said jaw means further comprises a jaw having one end pivotally secured to said lug-receiving means and further comprising a set of jaw teeth provided on said jaw, with said jaw teeth facing said lug teeth on said lug when said lug is disposed in said engaging configuration.

5. The lid wrench of claim 1 wherein said lug-receiving means is further characterized by an elongated lug bar having a lug-receiving segment for slidably receiving said lug means.

6. The lid wrench of claim 5 wherein:

(a) said lug opening is tapered at the top and bottom and further comprising lug teeth provided on said lug, whereby said lug is selectively locked on said lug-receiving means in non-slidable configuration with said lug teeth facing said jaw means; and (b) said jaw means further comprises a curved jaw having one end pivotally secured to said lug bar and further comprising a set of jaw teeth provided on the concave side of said jaw, with said jaw teeth facing said lug teeth on said lug.

7. The lid wrench of claim 1 further comprising bias means disposed between said lug-receiving means and said jaw means, said bias means having one end engaging said lug-receiving means and the opposite end of said bias means engaging said jaw means, for normally biasing said jaw handle in extended relationship with respect to said fixed handle and said jaw means in extended relationship with respect to said lug means.

8. The lid wrench of claim 7 wherein said lug opening is tapered at the top and bottom and further comprising lug teeth provided on said lug, whereby said lug is selectively locked on said lug-receiving means in non-slidable configuration with said lug teeth facing said jaw means.

9. The lid wrench of claim 8 wherein said jaw means further comprises a curved jaw having one end pivotally secured to said lug-receiving means and further comprising a set of jaw teeth provided on the concave side of said jaw, said jaw teeth facing said lug teeth on said lug when said lug is disposed in said non-slidable configuration.

10. The lid wrench of claim 9 wherein said lug-receiving means is further characterized by an elongated lug bar having a lug-receiving segment for slidably receiving said lug means.

11. The lid wrench of claim 1 further comprising bar teeth provided on said lug-receiving means for engagement by said lug means and selectively locking said lug means on said lug-receiving means and securing the lid between said lug means and said jaw means.

12. The lid wrench of claim 11 wherein:

(a) said lug opening is tapered at the top and bottom for engaging said bar teeth and further comprising lug teeth provided on said lug, whereby said lug is selectively locked on said lug-receiving means in non-slidable configuration with said lug teeth facing said jaw means; and (b) said jaw means further comprises a curved jaw having one end pivotally secured to said lug-receiving means and further comprising a set of jaw teeth provided on the concave side of said jaw, said jaw teeth facing said lug teeth on said lug when said lug is disposed in said non-slidable configuration.

13. The lid wrench of claim 12 wherein said lug support is further characterized by an elongated lug bar having a lug-receiving segment for receiving said lug means and an offset handle mount segment extending from said lug-receiving segment.

14. The lid wrench of claim 13 further comprising bias means having one end engaging said lug bar and the opposite end of said bias means engaging said jaw for normally biasing said jaw handle in extended relationship with respect to said fixed handle and said jaw in extended relationship with respect to said lug.

15. The lid wrench of claim 14 wherein said bias means further comprises a coil spring.

16. The lid wrench of claim wherein said lug-receiving means is further characterized by a polygonal cross-section.

17. The lid wrench of claim 16 wherein:

(a) said jaw means further comprises a curved jaw having one end pivotally secured to said lug-receiving means and further comprising a set of jaw teeth provided on the concave side of said jaw, with said jaw teeth facing said lug teeth on said lug means when said lug means is disposed in said non-slidable configuration; and (b) said lug opening is tapered at the top and bottom and further comprising lug teeth provided on said lug means, whereby said lug is selectively locked on said lug-receiving means in non-slidable configuration with said lug teeth facing said jaw.

18. The lid wrench of claim 17 further comprising bar teeth provided on said lug-receiving means for engaging said lug means and selectively locking said lug means on said lug-receiving means and securing the lid between said lug means and said jaw means.

19. A lid wrench for loosening a lid from a container, comprising an elongated lug bar; lug means having a bevelled lug opening for receiving said lug bar in slidable relationship; a fixed handle carried by one end of said lug bar in fixed relationship; a jaw pivotally carried by said one end of said lug bar in spaced relationship with respect to said lug means; and a jaw handle carried by said jaw in fixed relationship, whereby said lug means and said jaw engage the lid and the lid is loosened on the container responsive to insertion of said lid wrench over the lid with the lid located between said lug means and said jaw, squeezing said jaw handle toward said fixed handle to lock said lug means on said lug bar and twisting said lid wrench.

20. The lid wrench of claim 19 wherein said lug means further comprises a lug transversely spanning said lug bar, at least one lug shoulder provided in said lug opening and lug teeth provided on said lug, whereby said lug is selectively pivoted with respect to said lug support to engage said lug shoulder and said lug bar in non-slidable, locked configuration, with said lug teeth facing said jaw means.

21. The lid wrench of claim 20 wherein said lug bar is further characterized by an elongated member having a cross-section shaped in the configuration of a polygon.

22. The lid wrench of claim 21 further comprising bar teeth provided on said lug bar for engagement with said lug shoulder and selectively locking said lug on said lug bar for securing the lid between said lug and said jaw.

23. The lid wrench of claim 22 further comprising bias means having one end engaging said lug bar and the opposite end of said bias means engaging said jaw, for normally biasing said jaw handle in extended relationship with respect to said fixed handle and said jaw in extended relationship with respect to said lug.

24. The lid wrench of claim 23 wherein said bias means further comprises a coil spring.

25. A lid wrench for loosening a lid from a container, comprising an elongated, round bar; a longitudinal slot provided in said bar; a lug having a bar opening for receiving said bar and a pin carried by said lug, said pin projecting into said bar opening and said slot, whereby said lug is slidably and non-rotatably disposed on said bar for selectively engaging said bar in locked configuration; a fixed handle carried by said bar in fixed relationship; a curved jaw pivotally carried by said bar in spaced relationship with respect to said fixed handle; and a jaw handle fixedly carried by said curved jaw, whereby said lug is slidably adjusted on said bar to engage the lid when said curved jaw engages the opposite side of the lid and the lid is loosened on the container responsive to insertion of said lid wrench over the lid with the lid located between said lug and said curved jaw, squeezing said jaw handle toward said fixed handle and twisting said lid wrench in the counterclockwise direction.

26. The lid wrench of claim 25 further comprising bar teeth provided on said bar for engaging said lug and selectively locking said lug on said bar and securing the lid between said lug and said jaw.

27. The lid wrench of claim 26 further comprising bias means having one end engaging said bar and the opposite end of said bias means engaging said jaw, for normally biasing said jaw handle in extended relationship with respect to said fixed handle and said jaw in extended relationship with respect to said lug.

28. The lid wrench of claim 27 wherein said bias means further comprises a coil spring.

* * * * *